US008025581B2

(12) United States Patent
Bryan et al.

(10) Patent No.: US 8,025,581 B2
(45) Date of Patent: Sep. 27, 2011

(54) INTERACTIVE INTERFACE MOUNTING ASSEMBLY FOR AMUSEMENT AND THEME PARK RIDES

(75) Inventors: Susan M. Bryan, Los Angeles, CA (US); Gregory A. Wilzbach, Santa Clarita, CA (US); James Stephen Frankenberger, Simi Valley, CA (US)

(73) Assignee: Disney Enterprises, Inc., Burbank, CA (US)

( * ) Notice: Subject to any disclaimer, the term of this patent is extended or adjusted under 35 U.S.C. 154(b) by 669 days.

(21) Appl. No.: 12/177,303

(22) Filed: Jul. 22, 2008

(65) Prior Publication Data

US 2009/0277295 A1 Nov. 12, 2009

Related U.S. Application Data

(60) Provisional application No. 61/127,016, filed on May 9, 2008.

(51) Int. Cl.
*A63G 1/00* (2006.01)
*A63G 31/00* (2006.01)

(52) U.S. Cl. ..... 472/43; 472/130; 463/2

(58) Field of Classification Search ..... 472/43, 472/59–61, 13, 130; 463/1, 2, 7; 273/440, 273/441, 442

See application file for complete search history.

(56) References Cited

U.S. PATENT DOCUMENTS

| | | | | |
|---|---|---|---|---|
| 5,629,595 | A | 5/1997 | Salter et al. | |
| 5,716,281 | A * | 2/1998 | Dote | 472/60 |
| 6,060,847 | A | 5/2000 | Hettema et al. | |
| 6,152,828 | A * | 11/2000 | Tomita et al. | 472/60 |
| 6,224,491 | B1 * | 5/2001 | Hiromi et al. | 472/59 |
| 6,287,211 | B1 * | 9/2001 | Bolliger et al. | 472/43 |
| 6,431,989 | B1 * | 8/2002 | Katayama et al. | 472/60 |
| 6,773,016 | B2 * | 8/2004 | Ochi | 273/448 |
| 6,796,908 | B2 | 9/2004 | Weston | |
| 7,762,895 | B2 * | 7/2010 | Zamperla et al. | 472/43 |
| 2003/0106455 | A1 | 6/2003 | Weston | |
| 2006/0293110 | A1 | 12/2006 | Mendelsohn | |

* cited by examiner

*Primary Examiner* — Kien T Nguyen
(74) *Attorney, Agent, or Firm* — Marsh Fischmann & Breyfogle LLP; Kent A. Lembke

(57) ABSTRACT

A ride vehicle for use in amusement park rides with interactive game or show equipment. A vehicle body is included with a passenger seat and an interactive device operable by a passenger to interact with the interactive game. A mounting assembly is provided in or on vehicle body and is configured for pivotally mounting the interactive device on the vehicle body. The mounting assembly may be adapted such as with a cam or guide plate to rotate or otherwise position the interactive device through a range of positions at varying distances from the seat. Further, A passenger restraint assembly is provided and is used to determine a size of the passenger in the seat. The passenger restraint is linked to the mounting assembly to drive the mounting assembly so as to place the interactive device at a passenger-use position that is selected based on the defined size of the passenger.

20 Claims, 10 Drawing Sheets

INTERACTIVE INTERFACE MOUNTING ASSEMBLY FOR AMUSEMENT AND THEME PARK RIDES

CROSS-REFERENCE TO RELATED APPLICATIONS

This application claims the benefit of U.S. Provisional Application No. 61/127,016 filed May 9, 2008, which is incorporated herein by reference in its entirety.

BACKGROUND

Recently, there has been a growing need for devices allowing a human operator or user to interact with a user interface to use or operate an electronic device such as a video game player or to perform mechanical devices remotely. For example, a growing application or need for interactive devices is interfaces that promote interacting in a natural, easy-to-use, and realistic manner with computer-generated environments such as are provided in interactive games or rides at amusement parks. For example, interface devices or game controllers (sometimes referred to as "guest interactive devices") may be designed to allow the user or operator to interact with the displayed environment of a ride or show by inputting commands or data by manipulating one or more actuable or movable components on the user interface or game controller. Popular interfaces include joysticks, button and joystick-based game controllers, gun or launching device with a trigger or release, mice, trackballs, steering wheels, foot or hand pedals, pads for simulating dance, or the like. These interface devices are each connected to the computer system that functions to render and control functionality of the displayed game or interactive environment (e.g., a ride controller or control system). The computer runs a game program to update the displayed interactive environment in response to input signals from the interface device based on the user's manipulation of the component (e.g., a manipulandum) such as a joystick handle, a trigger or release, a wheel, or a mouse. The computer via the game program also provides visual feedback to the user using the display screen such as by displaying a projectile or object fired or released in response to a trigger or release being pulled or activated on the user interface.

One difficulty facing designers of rides or shows with interactive or interface devices is how to properly position a guest interactive (or interface) device (or GID) within a vehicle, which is used to move the guests or visitors through the ride or show. Generally, the GID should be positioned in a different optimal position to suit each guest or rider so as to suit their size for ergonomic and other reasons and also should be provided or mounted in the vehicle to be out of the way during loading and unloading operations. Determination of an optimal or ergonomically desirable position for the GID should take into account: the height of all or portions of the GID relative to a guest's eye height/location (e.g., their line of sight relative to the top or side of the GID allowing targeting of the GID when appropriate for the interactive game/ride but also to avoid blocking a guest's view); the distance from the guest's torso for good reach or access ergonomics for the GID; and a desired game/ride position for the controller (e.g., within a horizontal plane relative to the ride floor or the like).

Regarding loading and unloading, the design of a GID and its mounting devices is complicated by the desire in some applications to move or reposition the GID into a location for game play after or as part of the load cycle but without relying upon guest intervention for positioning of the GID during or after play. A further complication is that the mounting devices or mechanisms need to support the creative constraints of a ride or game environment (e.g., supports should be properly "themed" when possible) and/or to support game parameters or demands. For example, some game applications call for a GID that is operated by a user to launch a projectile and/or to target a portion of the ride environment (e.g., an alien, a basketball hoop, a pirate ship, and so on). In such cases, the game controller and/or its game program may require accurate information on the location and orientation of the GID (e.g., three-dimensional (3D) location information including pitch and yaw information) in order to generate a virtual projectile but yet be creatively designed to have a look and feel that fits the particular ride environment.

Prior solutions generally have not been adequate to meet all the demands or design requirements for an interactive ride or show. For example, some rides have vehicles with interactive devices or GIDs that are tethered to the vehicle, and the guests or riders can remove the interactive devices from a receptacle upon loading and then hold the devices in their hands during the ride. While a tethered system may improve usability for all but the youngest guests, tethered systems are often undesirable due to maintenance issues and can have inherent robustness problems. Further, many interactive ride/show applications require 3D location information to correctly operate, and tethered systems in which the devices are freely moved by the guest typically cannot provide such 3D location/position information. Other interactive ride designs call for the interactive device or GID to be hard mounted to a dashboard or other portion of a vehicle body. The positioning is selected for an "average" sized guest and, as a result, is not properly positioned for guests that are either smaller (e.g., young children) or larger than the selected average sized person, which makes use of the interactive device difficult or uncomfortable for many guests.

Hence, there remains a need for improved mechanisms for mounting interactive devices or game controllers within vehicles used in interactive rides or shows. Preferably such mounting mechanisms would be adapted to facilitate loading and unloading of vehicles and would account for varying sizes of vehicle passengers or guests. Further, such mounting mechanisms preferably would allow for collection of accurate 3D positioning information for the interactive device within the vehicle.

SUMMARY OF THE INVENTION

The present invention addresses the above problems by providing a mounting and interconnection assembly useful in vehicles of interactive rides and shows. The mounting assembly is adapted to provide a known or determinable position of an interactive device or GID while placing the GID in a position that may be selectively varied (or established) during loading depending upon the size of a guest or passenger seated in the vehicle. For example, the mounting assembly may provide a linkage between a passenger restraint, such as a lap bar, and an interactive device such that the interactive device is moved or positioned with and/or based upon movement and positioning of the passenger restraint. To account for varying guest sizes, the linkage of the mounting assembly may include a drive mechanism (such as a guide plate with a non-linear guide slot) to cause the interactive device to be moved or rotated at more than one rate or amount (such as at two or more rates or amounts) while the passenger restraint is moved over a path from a load/unload position to a locked or passenger restraint position. In this manner, a separation distance between a user interface portion of the GID and the restraint (e.g., a lap bar) may be varied to provide desired ergonomics for guests of varying size rather than only providing one distance to suit an average sized guest. For example, the GID-restraint separation distance may be larger for larger guests where the lap bar is only moved through a first portion from the unload/load position and smaller for smaller guests where the lap bar is moved through the first portion into and/or through a second portion away from the unload/load position.

To this end, an apparatus is provided that mounts an interactive device in a ride or show vehicle that includes a passenger restraint to protect a passenger of the vehicle. The apparatus includes: a support frame rigidly attached to the vehicle; an attachment mechanism for pivotally attaching the interactive device to the support frame; and a drive mechanism for linking the passenger restraint to the attachment mechanism. The movement of the passenger restraint from a loading and unloading position to a position to restrain a passenger within the vehicle drives (e.g., via the drive mechanism) moves the interactive device from a loading and unloading position to an interactive use position. In some embodiments, the drive mechanism includes a guide element causing the interactive device to move at a first rate relative to the passenger restraint during a first portion of a travel path of the passenger restraint and at a second rate relative to the passenger restraint during a second portion of the travel path, with the second rate being greater than the first rate and the first portion of the travel path being proximate to the loading and unloading position of the passenger restraint. In some embodiments, the guide element includes a guide plate with a guide slot having a first region associated with the first portion of the travel path and a second region associated with the second portion of the travel path. In some cases, the passenger restraint is pivotally mounted to the support frame and connected to the guide plate such that the guide plate moves concurrently with the passenger restraint. Further, the drive mechanism may include a driver linkage connected at a first end to the guide plate via the guide slot and at a second end to the attachment mechanism of the interactive device, whereby the interactive device is positioned concurrently with the passenger restraint.

According to another aspect, a vehicle assembly may be provided for use in an interactive ride. The vehicle assembly may include: a body with a seat for a guest; a mounting assembly attached to the body a distance from the seat; a lap bar restraint pivotally mounted to the mounting assembly and including a lap bar positionable in a load and unload position and in a guest restraint position; and a guest interactive device pivotally mounted to the mounting assembly. In some embodiments, the mounting assembly includes an interconnection assembly connecting the lap bar restraint to the guest interactive device such that when the lap bar is moved through a path from the load and unload position to the guest restraint position the guest interactive device is concurrently moved from a load and unload position distal from the seat to a guest interaction position proximate to the seat. In some further embodiments, the path of the lap bar includes a first portion proximate to the load and unload position and a second portion distal to the load and unload position. Further, the lap bar and the interactive device may be spaced apart a separation distance that varies over the path of the lap bar and is greater in the first portion. In some such embodiments, the interactive device is moved (e.g., laterally or through its travel path that may be arcuate or a differing shape) at a first rate during the first portion and at a second rate during the second portion, the second rate being greater than the first rate. The interactive device may include a planar base pivotally attached to an arm extending from the mounting assembly, the arm providing the pivotal mounting of the mount assembly, whereby the planar base is maintained in a substantially consistent position relative to a platform or floor supporting the body (or the floor or another portion of the body) during movement of the lap bar along the path from the load and unload position to the guest restraint position.

According to yet another aspect, a ride vehicle is provide for use in an amusement or theme park ride that uses interactive game or show equipment to entertain guests or passengers of the vehicle. A vehicle body is included with a seat for a passenger and an interactive device operable by the passenger to interact with the game or show equipment. A mounting assembly is provided in or on the vehicle body and is configured for pivotally mounting the interactive device on the vehicle body. The mounting assembly may be adapted such as with a cam or guide plate to rotate or otherwise position the interactive device through a range of positions at varying distances from the seat. Further, means for defining a size of the passenger in the seat are provided with the ride vehicle. The passenger size defining means provides input to the mounting assembly to drive the mounting assembly so as to place the interactive device at a passenger-use position (e.g., a particular position within the range of positions) that is selected based on the defined size of the passenger.

For example, the size defining means may include a passenger restraint that is linked to the interactive device by the mounting assembly (or a linkage assembly therein). The movement of the passenger restraint to a passenger restraint position proximate to the passenger in the seat drives or forces the interactive device to move to the passenger-use position. The passenger restraint may be a lap bar restraint that is pivotally connected to the mounting assembly, and during use of the ride vehicle, rotating the lap bar restraint into the passenger restraint position causes the interactive device to rotate (at least partially concurrently) via the mounting assembly into the passenger-use position. The mounting assembly may include a variable drive element that is configured to rotate the interactive device in response to rotation of the lap bar restraint at two or more rotation rates relative to the movement of the lap bar restraint (e.g., the interactive device is rotated at different rates than the lap bar at least in a portion of its travel from an unload/load position to the passenger-use position). The variable drive element of the mounting assembly may include a guide plate with a guide slot that has at least two portions each associated with the rotation rates of the interactive device, and initial rotation rates associated Wraith a load/unload position of the lap bar restraint may be smaller in magnitude than later rotation rates associated with the lap bar restraint being moved into a passenger restraint position nearer the seat. To this end, the portion of the guide plate slot associated with the initial rotate rate may be more vertical such as at an angle of less than about 30 degrees or even substantially vertical.

DETAILED DESCRIPTION OF THE PREFERRED EMBODIMENTS

Figure 1:
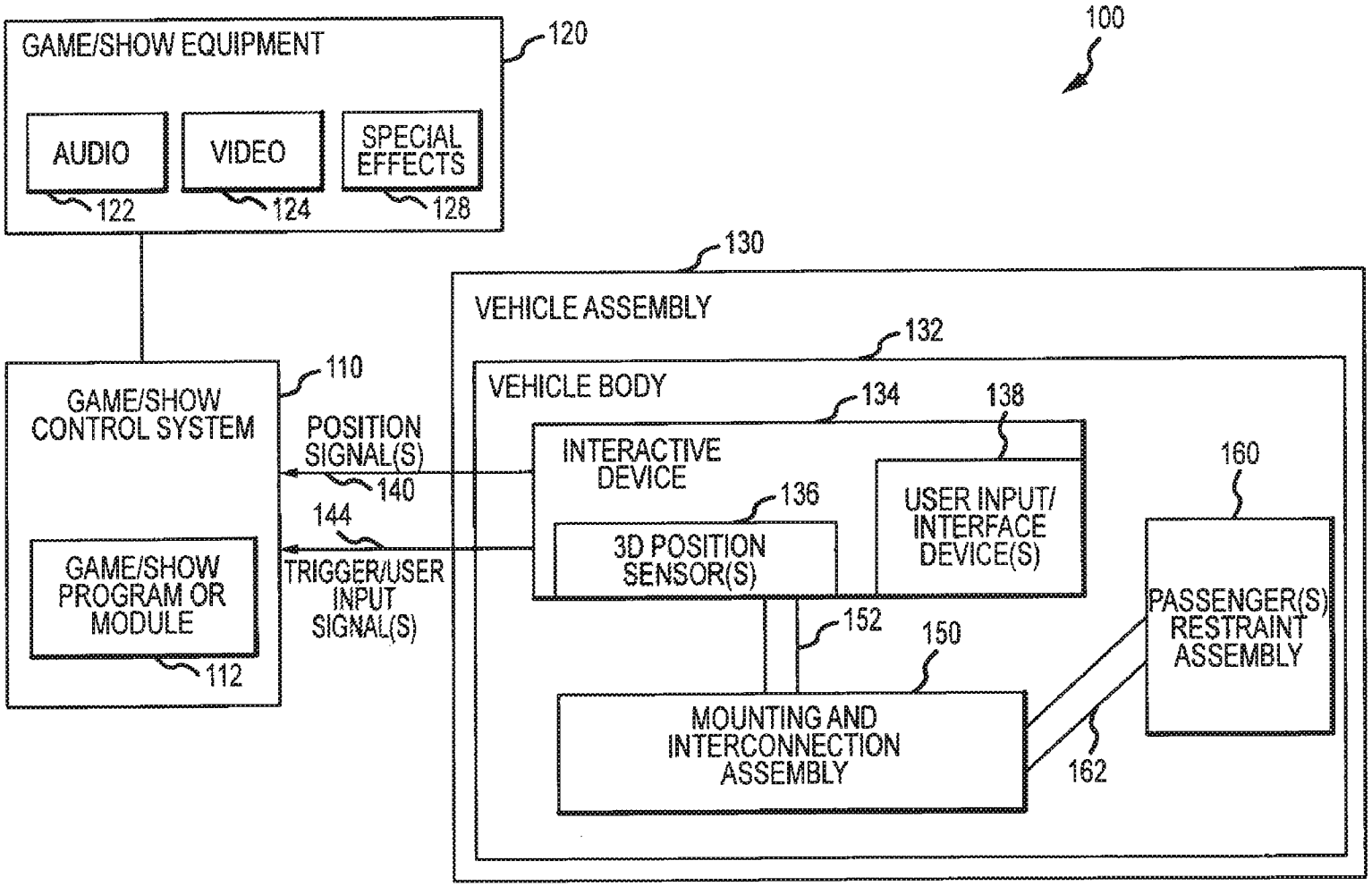
FIG. 1 is a functional block diagram of an interactive ride/show system with a mounting and interconnection assembly positioning a guest interactive device/game controller based on positioning of a passenger restraint assembly (or a portion thereof)

Briefly, embodiments of the present invention are directed to a mounting and interconnection assembly for use in physically supporting and mounting an interactive device or game controller within a ride vehicle such that its 3D position is variable and selected based upon (or associated with) a position of one or more components of a passenger restraint assembly in the vehicle (e.g., a position of the interactive device is set or defined by a position of a lap bar or other passenger restraint component). The mounting and interconnection assembly (or, more simply, the mounting assembly) described herein is designed to account for not just an average person or body size but also the outer ranges of guest body types such as large adults and small children without requiring custom adjusting of the device position by an operator or by the guest/passenger of the vehicle. In some embodiments, the interactive device is located or interconnected to a lap bar-type restraint with the mounting assembly, which may be considered a jointed, GID mount. In this way, the position of the interactive device is tied to or directly determined by a size and/or shape of the guest such as by their upper body and/or lap size and shape. The mounting and interconnection assembly is configured to allow for the lap bar or passenger restraint to provide secure restraint of the guest while also providing moving and/or enhanced/optimal positioning of the interactive device based on movement and positioning of the lap bar restraint. For example, the interactive device may be attached or linked to the lap bar restraint via a mounting assembly that includes a multi-joint mount that keeps the interactive device in proper orientation (e.g., with a base plate or portion in a horizontal plane or some other game-driven or required position such as in a vertical plane or an angled position) while positioning the interactive device relative to (e.g., in front of) the guest.

The mounting assembly is configured such that the interactive device moves with the lap bar restraint. In some embodiments, the amount of movement or range of motion for the interactive device and the lap bar are similar (e.g., the interactive device and lap bar are both rotated through a like angle such as from 90 degrees relative to horizontal (e.g., a load/unload position with the interactive device out of the way and the lap bar released/up) to 60 degrees for an adult or to 45 degrees for a smaller adult or child, e.g., with the lap bar in a locked or passenger-restrained position). However, in many embodiments, the mounting assembly interconnects the lap bar restraint and the interactive device (or its mount assembly/mechanism) such that the movement or positioning of the interactive device differs or varies with the amount or range of movement of the lap bar from a load/unload position to a locked or passenger-restrained position.

For example, during use, guests with smaller torsos allow the lap bar restraint to travel further down (e.g., through a larger angle of rotation), and the mounting assembly is configured such that this movement of the lap bar restraint causes the interactive device to be positioned lower (e.g., in a lower horizontal plane) and also closer to a vehicle seat. In other words, a device-seat separation distance may be smaller such that the device is closer to the passenger to account for the fact that a person/guest with a smaller torso likely will also have shorter arms. With guests with larger torsos and/or laps, the lap bar restraint is moved a smaller amount or through a smaller angle of rotation relative to the load/unload position of the lap bar restraint.

The mount assembly is configured to position the interactive device at a height above or in a horizontal plane that is higher than that of the smaller torso/lap guest (e.g., to place the device more proximate to the guest's eyes or line of sight) and such that the device-to-seat distance is greater than for the smaller torso/lap guest to account for the greater reach or longer arms. In practice, the mounting assembly is adapted to account for a range of torso and/or lap sizes of guests by landing or positioning the GID to provide a desired amount of space between the guest and the GID to enhance the ergonomics for GID use by the guest and also to align the GID at a height (e.g., a horizontal plane) to place the GID at some predefined distance below eye level (e.g., to provide a line of sight for the guest that is a distance above the top of the GID).

In order to account for the fact that there is a large variation of adult torso sizes but relatively little difference in arm length compared to children's torso to arm length ratios, the actual amount of change in the location of the GID over the path of the restraint (or with movement of the lap bar restraint from load/unload position to locked/restrained position) is established by the design of the mounting assembly such that the GID moves relatively slowly (or through a smaller rotation angle) at the beginning of the restraint travel path (e.g., at the larger-guest portion/end of the path) and then moves relatively quickly or accelerates (or through a larger rotation angle) near the end of the restraint travel path (e.g., at the smaller-guest portion/end of the path). Thus, the GID is caused to move with the interconnected lap bar restraint more at the child or small-guest end of the path so as to account for the variation in arm length of very young children versus older children.

The particular path of the GID relative to the travel path of the lap bar restraint may be controlled with a linkage that includes a plate with guide slots or grooves defining a non-linear path setting the rotation or positioning path of the GID relative to the rotation of the restraint. In such cases, the particular path of the GID may be easily adjusted via changes to the plate, e.g., by machining or providing a differing guide slot or groove to allow for adjustment after installation and testing/use by numerous guests. Significantly, because the GID is tied or connected to the lap bar, no additional intervention from the guest is required to properly position the GID for interactive game play as positioning of the restraint results in concurrent positioning of the GID in a desirable 3D orientation. As will become clear from the following description, the mounting assembly of the invention allows for a "hard mounted" (rather than simply tethered) GID with the ability for real-time gathering of orientation information or 3D position information, while also providing the ability to position the GID optimally for a variety of guest sizes as well as moving the GID out of the way for loading and unloading of the ride vehicle.

FIG. 1 illustrates an exemplary interactive ride or show system 100 that may utilize the GID/interactive device mounting techniques of the invention to provide desirable positioning of the GID/device relative to a guest as well as supporting or facilitating determination of the 3D position and/or orientation of the device, which may include yaw, pitch, spatial coordinates, and/or other information. The system 100 includes a game or show controller or control system 110 that typically includes a computer/processor with memory or data storage that runs one or more game/show programs or software modules 112 to process information about the location of a vehicle 130 and input from one or more guests/riders in the vehicle 130 to create a desired show or interactive experience. For example, the game program 112 may receive position signals 140 from the vehicle assembly 130 indicating a position of a guest interactive device 134 as well as user input or triggering signals 144 and respond by operating a set of game or show equipment 120.

The game or show equipment 120 may include audio devices 122 for outputting desired noises, sound effect, audio tracks, and the like associated with or based on user input 144 and/or the program 112. Video devices 124 may be used to create effects such as lighting of targets, flashing when a target is hit, displaying animation or video on a display screen (s), and/or showing a projectile launched from the interactive device 134 based on the 3D position/orientation of the interactive device (e.g., the position and angle of the outlet of the device 134) as determined by the position signals 140 or otherwise. The show equipment 120 may also include special effects components 128 such as robotic objects/characters that may be operated based on the location of the vehicle assembly 130 and on the operation of the interactive device 134. The game/show equipment 120 may be operated by the control system 110 based on the particular game program 112 and the signals/input data 140, 144 from the interactive device 134 as well as other information and may be operated in nearly any combination and order to create an interactive game or show for riders/guests in the vehicle body 132, with at least some of the game equipment 120 being positioned near or adjacent the vehicle assembly 130 such as near a track to interact with users of the interactive device 134 when the vehicle body 132 carrying guests or riders moves along a track or over a path through the show/ride equipment 120.

The system 100 includes a vehicle assembly 130 with a vehicle body 132 for carrying one or more passengers or guests (not shown but typically provided in a seat(s) in the body 132). Within or attached to the vehicle body 132, the vehicle assembly 130 includes an interactive device or GID 134 with sensors or devices 136 for sensing the location and, in some cases, orientation of the interactive device 134 in 3D space or relative to a portion of the body 132. The 3D position sensors 136 may output position signals 140 that are processed by the game program 112 to determine, for example, the horizontal position or height location of the GID 134 as well as, in some cases, the orientation of the device 134 (e.g., the 3D position of an outlet or end of a barrel or targeting portion of the device 134 as well as its angle or other information (e.g., yaw and pitch) so as to allow virtual projectiles to be launched from the device 134 by the program 112 operating the game/show equipment 120). The interactive device 134 may include user input/interface devices 138 such as triggering mechanisms, control pads, mice, buttons, touch screens, and the like, and output from the devices 138 may be sent as signals 144 to the game/show control system 110 for processing/use by the game program 112 (e.g., to determine when to show a projectile, to fire a laser, to shoot a basket, to throw a ball, to shoot a jet of water, and so on).

The vehicle assembly 130 also includes a passenger restraint assembly 160 such as, but not limited to, a lap bar restraint that is positioned during loading of a passenger/guest in the vehicle body 132 so as to restrain the passenger in the body 132. The restraint assembly 160 typically operates uniquely to account for differing passenger sizes so as to comfortably but securely restrain smaller guests (such as children) as well as larger guests such as adult guests. For example, the assembly 160 may include a lap bar-type restraint that is positioned in a first location for a large torso/lap guest and a second location for a small torso/lap guest, with the first location generally being a greater distance from the back of the seat and also at a greater height above the seat bottom relative to the second location.

Significantly, the vehicle assembly 130 also includes a mounting and interconnection assembly 150 that is configured to support/mount the interactive device 134 and the passenger restraint 160 (or a portion of the assembly 160) within or near the vehicle body 132 while also interconnecting the interactive device 134 and restraint 160 such that their movements are coordinated. The mounting and interconnection assembly 150 is generally adapted to account for varying sizes of guests/riders in the vehicle body 132 by positioning the interactive device 134 based on the position of the passenger restraint assembly 160 (e.g., based on a location of the lap bar relative to a vehicle seat (not shown) in body 132 such as relative to the distances of the lap bar from the seat and/or seat back). The mounting and interconnection assembly 150 may be implemented in a number of ways but generally may be a multi-joint assembly tying or linking positioning of the interactive device 134 to positioning of the passenger restraint assembly 160. For example, positioning of the interactive device 134 in response to an amount or magnitude of rotation of the lap top restraint about a pivotal mounting point(s). In some cases, the positioning of the interactive device 134 is controlled by the mounting assembly 150 such that the interactive device 134 has its base retained in a horizontal plane (or other game/ride dictated interaction position).

This positioning may also be controlled by the mounting assembly 150 such that the movement of the interactive device 134 varies in magnitude and/or rate over the path or range of movement of the passenger restraint assembly 160 such the interactive device 134 has less or slower movement in the initial portion of the path or range of movement of the restraint assembly 160 and a greater amount of movement in the middle and/or later portions of the path or range of movement of the restraint assembly 160. For example, a lap bar may be rotated over a path of about 30 to 60 degrees to move it from a load/unload position to a locked/restrained position based on the size of the guest's torso/lap and in the first portion of the path or first 30 degrees the interactive device may be moved a relatively small amount relative to the seat (in lateral and/or height directions) while in the second portion of the path or second 30 to 60 degrees the interactive device may be moved a relatively large amount. The relative amount of movement of the interactive device 134 may also be measured as a distance between the interactive device 134 and the passenger restraint assembly 160 or a distance between a portion of each such as a lateral distance between an end (or the user interface) of the interactive device 134 and a center of a lap bar of the restraint assembly 160 (e.g., a GID-restraint distance).

Figure 2:
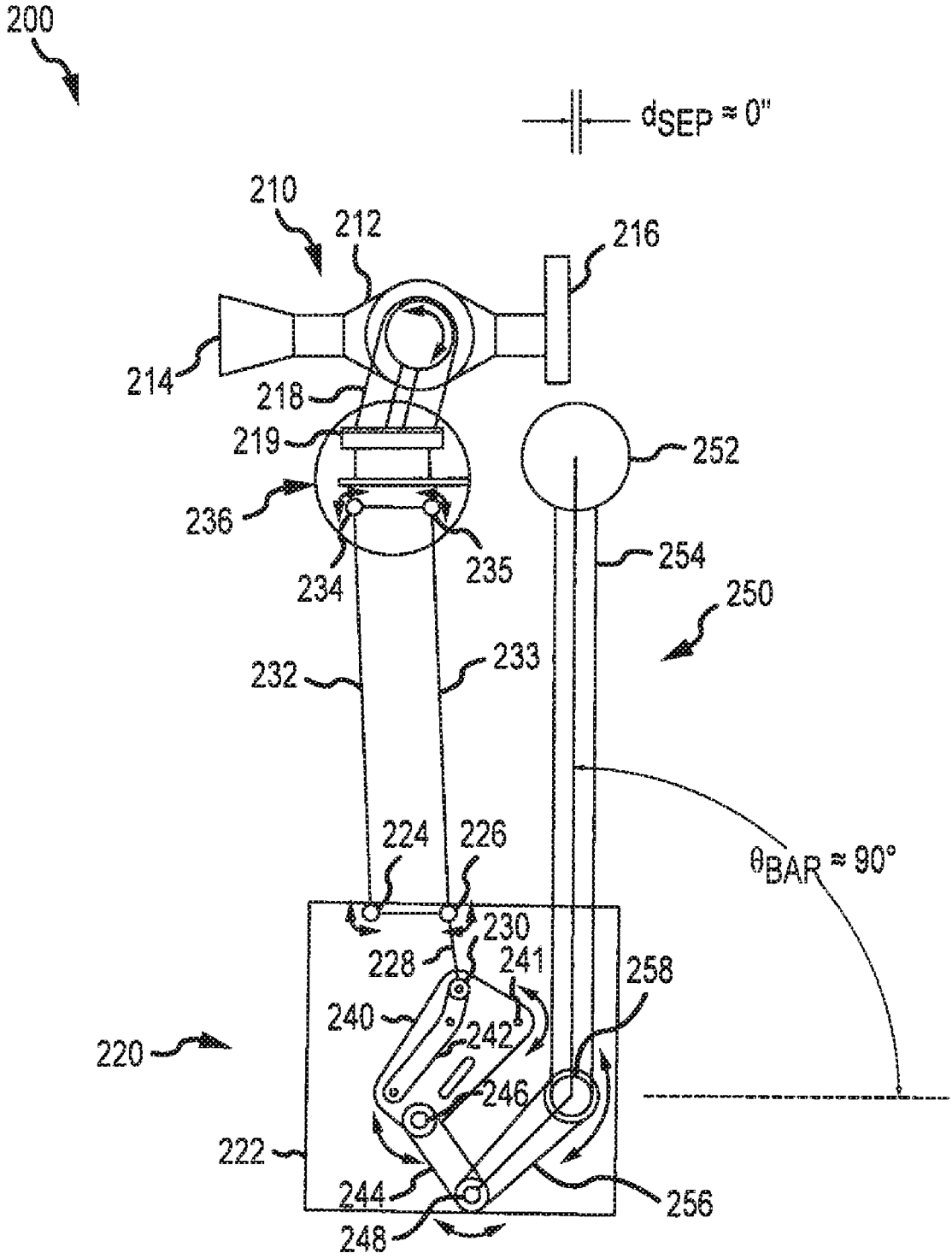
FIGS. 2-4 illustrate an embodiment interactive device and passenger restraint assembly such as may be provided in the interactive ride/show system of FIG. 1.
Figure 3:
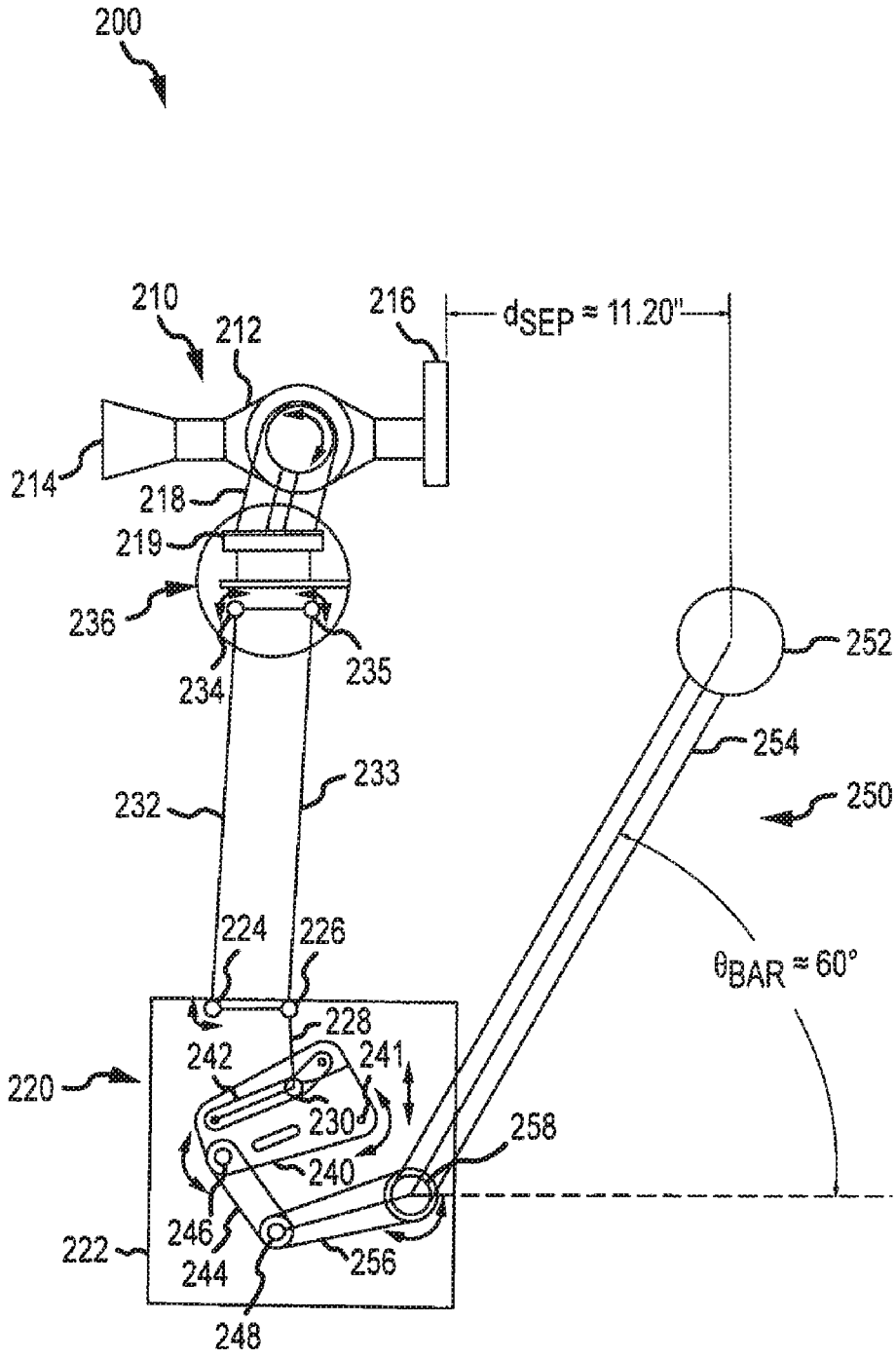
Figure 4:
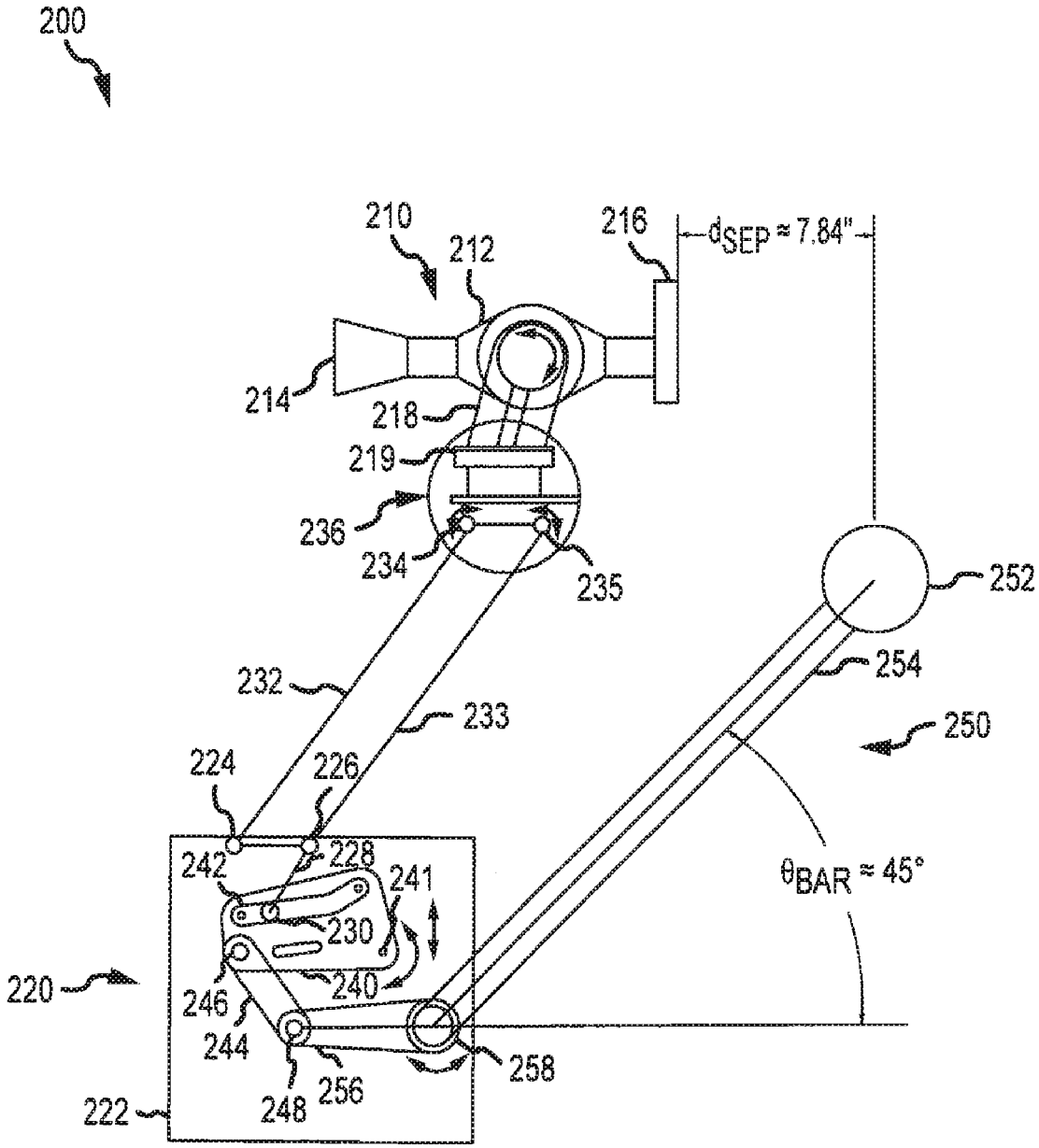

FIGS. 2-4 illustrate an interactive device and passenger restraint assembly 200 of an embodiment of the invention in three operating positions, i.e., load/unload position in FIG. 2, locked/restrained position for a large torso/lap guest/passenger in FIG. 3, and locked/restrained (or loaded) position for a small torso/lap guest or passenger in FIG. 4. As discussed above, the assembly 200 (and its mount assembly 220) are configured to link or tie the positioning of an interactive device to a movement or positioning of a passenger restraint (here a lap bar restraint) so as to account for differing sizes and/or shapes of guests (or, more accurately, their torsos and/or laps) while maintaining a desired orientation of the GID (e.g., a base kept in a horizontal plane). The assembly 200 typically is used by positioning it within a vehicle body such that the restraint assembly 250 safely restrains one or more guests within a seat of the vehicle.

As shown, the assembly 200 includes a GID 210 with a body/frame 212, an outlet/muzzle 214, and user interface or input portion 216 (e.g., an end used by the guest to provide input such as triggering release of a projectile, firing a weapon, or the like). The body 212 is attached to a base or base plate 219 via arm/support(s) 218, and the body 212 may be mounted to the arm/support(s) 218 for rotation so as to change its angle of projection or pitch. In some cases, the base 219 is attached to interaction device support 236 so as to allow it to be rotated (e.g., to change the yaw). In some embodiments, the position of the outlet 214 and its orientation are used to allow the user/guest to interact with a ride/game, and, in such cases, sensors (not shown) in the device 210 may be used to provide output signals to a game program as was discussed for ride 100 of FIG. 1.

The assembly 200 further includes a mounting assembly 220 that supports and positions the interactive device 210 and also connects it to a restraint assembly 250 (and also supports the assembly 250 in some cases). To this end, the mounting assembly 220 includes a frame 222 that is typically rigidly attached to a vehicle body (not shown) such that the frame 222 moves with the body and is positioned at a known/desired position relative to a passenger seat of the vehicle body. The interactive device 210 is linked/supported by the frame 222 via one or more arms 232, 233 that are pivotally mounted at an interactive device end by pins, fasteners, or the like 234, 235 to interactive device support 236 and at a frame end by pins, fasteners, or the like 224, 226. In this manner, the arms 232, 233 are able to move back and forth (e.g., toward and away from a vehicle seat and its passenger(s)/guest(s)) while the base 219 of the interactive device 210 is maintained in a constant position relative to horizontal (e.g., kept in a horizontal plane or other game/ride interaction position). The movement or rotation of the arms 232, 233 through a rotation angle (not shown) is driven by link or arm 228 which may be rigidly attached to pin 226 (which, in turn, is allowed to rotate in a mounting hole or the like in frame 222). The driver link/arm 228 is connected at its opposite end to another pin/fastener or other element (such as a bearing) 230, and the driver link 228 rotates with the pin 230 causing the pin 226 and connected arms 232, 233 to rotate to drive the linked or interconnected interactive device 210.

A guide plate, variable cam, or cam plate 240 with a guide slot or groove 242 is provided in the mounting assembly 220, and the pin 230 attached to the driver link 228 is placed in the guide slot 242. The plate 240 is not restrained from movement by the frame 222 except that it may be supported via a pivotal mount device or pin 241, which in turn is supported by frame 222 (e.g., device 241 may be an elongate shaft or pin that extends through one or more supports or walls/plates of the frame 222). Significantly, the positioning of the interactive device 210 is linked and even forced by the positioning of a restraint assembly 250 connected to or linked to plate 240. To this end, the restraint assembly 250 includes a lap bar 252 that is placed against or near a passenger or guest's lap during operation of the ride (see, for example, FIGS. 3 and 4). The lap bar assembly 250 is connected to the mounting assembly 220 via a bar/rod 254 that extends down to a cross bar, pin, shaft, axle, or the like 258. The cross bar 258 extends through the frame 222 and is mounted so as to be able to rotate about its longitudinal or center axis as shown. Hence, the lap bar 252 may be rotated about the axis of the cross bar 258 to place it either in a load/unload position as shown in FIG. 2 (shown by lap bar displacement angle, $\theta_{BAR}$, as being about 90 degrees relative to horizontal) or a first loaded or locked position as shown in FIG. 3 for larger guests (e.g., guests with large torsos or laps/waist sizes) as shown with the bar displacement angle, $\theta_{BAR}$, being about 60 degrees or a second loaded or locked position as shown in FIG. 4 for smaller guests (e.g., guests with small torsos or laps/waist sizes) as shown with the bar displacement angle, $\theta_{BAR}$, being about 45 degrees.

To provide interconnection between the lap bar 252 and the interactive device 210, the mounting assembly 220 includes an arm or extension(s) 256 rigidly fixed or attached to the restraint crossbar 258 (or, in some cases, the rod 254). The extension 256 moves with the crossbar 258, e.g., rotates about the axis of the crossbar 258 when the lap bar 252 is moved. The mounting assembly 220 further includes a rod or link(s) 244 pivotally attached to the extension 256 by pin or bearing 248 and pivotally attached to a corner or other portion of the guide plate 240 by pin or bearing 246. As a result of this configuration of mounting assembly 220, rotation of the lap bar 252 from its load/unload position shown in FIG. 2 to the first loaded/restrained position shown in FIG. 3 causes the crossbar 258 to rotate about its axis. This rotation causes the extension 256 to move upward (or rotate about its end that is rigidly attached to crossbar 258), which pushes the link 244 upward causing the plate 240 to move, too and rotate about pin 241.

The amount and type of the movement of the plate 240 are dictated by the configuration of the guide slot 242 and other design characteristics such as mounting point of the link 244 to the plate 240, the length and location of the driver link 228, and more. From the load/unload position, the guide slot 242 is typically positioned to have a section that is substantially vertical or only slightly angled from a vertical plane such that a first movement of the bar 252 may result in little or even no movement of the GID (e.g., moves a pin within the substantially vertical upper or first portion of the guide slot 242). The slot 242 is shown to be similar to an open "7" or hockey stick with two linear sections, but numerous other shapes may be used such as a single or multi-section arcuate slot, a slot with more than two sections, and so on to achieve a desired coordinated movement of the lap bar or other restraint and the interconnected GID. As shown, the beginning position of the lap bar and the GID in the load/unload position is nearly the same for these two components but once the lap bar is moved to load a passenger the two components are spaced apart and are positioned in differing endpoints or locked/passenger restraint positions.

The plate 240 movement causes the driver link 228 to move (e.g., rotate), which rotates the pin 226 causing the movement of the arms 232, 233 and repositioning of the interactive device 210. In the illustrated example, movement of the lap bar 252 such that rod 254 is at an angle, $\theta_{BAR}$, of 60 degrees rather than 90 degrees (e.g., 30 degree rotation about the crossbar axis) causes the interaction device 210 to only be moved a relatively small amount or smaller fraction of its overall travel path/range. Such movement may be considered the movement from a load/unload position to a first loaded/restrained position associated with a larger guest. This results in a relatively large separation between the lap bar 252 and the user interface end 216 of the device 210, e.g., a GID-restraint separation distance, $d_{sep}$, of 8 to 14 inches with 11.2 inches shown as one useful example (with the separation distance often being a small amount such as less than about 8 inches in the load/unload position shown in FIG. 2 and sometimes less than an inch). As the lap bar 252 is moved through the first loaded/restrained position of FIG. 3 to the second loaded/restrained position of FIG. 4, the lap bar 252 is rotated about the axis of the crossbar 258 such that the rod 254 is at a second angle, $\theta_{BAR}$, of about 45 degrees. During this movement from the first loaded position to the second loaded position, the relative movement of the interactive device 210 is larger in magnitude (e.g., for a particular amount or number of degrees of rotation of bar 258 the device 210 is moved a greater amount toward the passenger or the vehicle seat). This is evidenced by the reduction in the amount of separation between the user interface end 216 of the device 210 from about 11 inches to about 8 inches (with the separation distance, $d_{sep}$, shown as 7.84 inches in FIG. 4 as one useful example). This varying rate of movement of the interface device 210 relative to movement/rotation of the lap bar 252 is defined/controlled by the configuration of the mounting assembly 220 such as by configuration of the guide plate 240 and its guide slot 242, which can be used to set and/or time the travel of the interactive device 210 relative to the lap bar 252. One or more position sensors (not shown) may be provided in or on the interactive device 210 (such on body 212 and/or on interactive device support 236) so that a game program and/or processor (not shown) may process sensor signals to determine spatial information about the device 210 throughout its use by a passenger.

Figure 5:
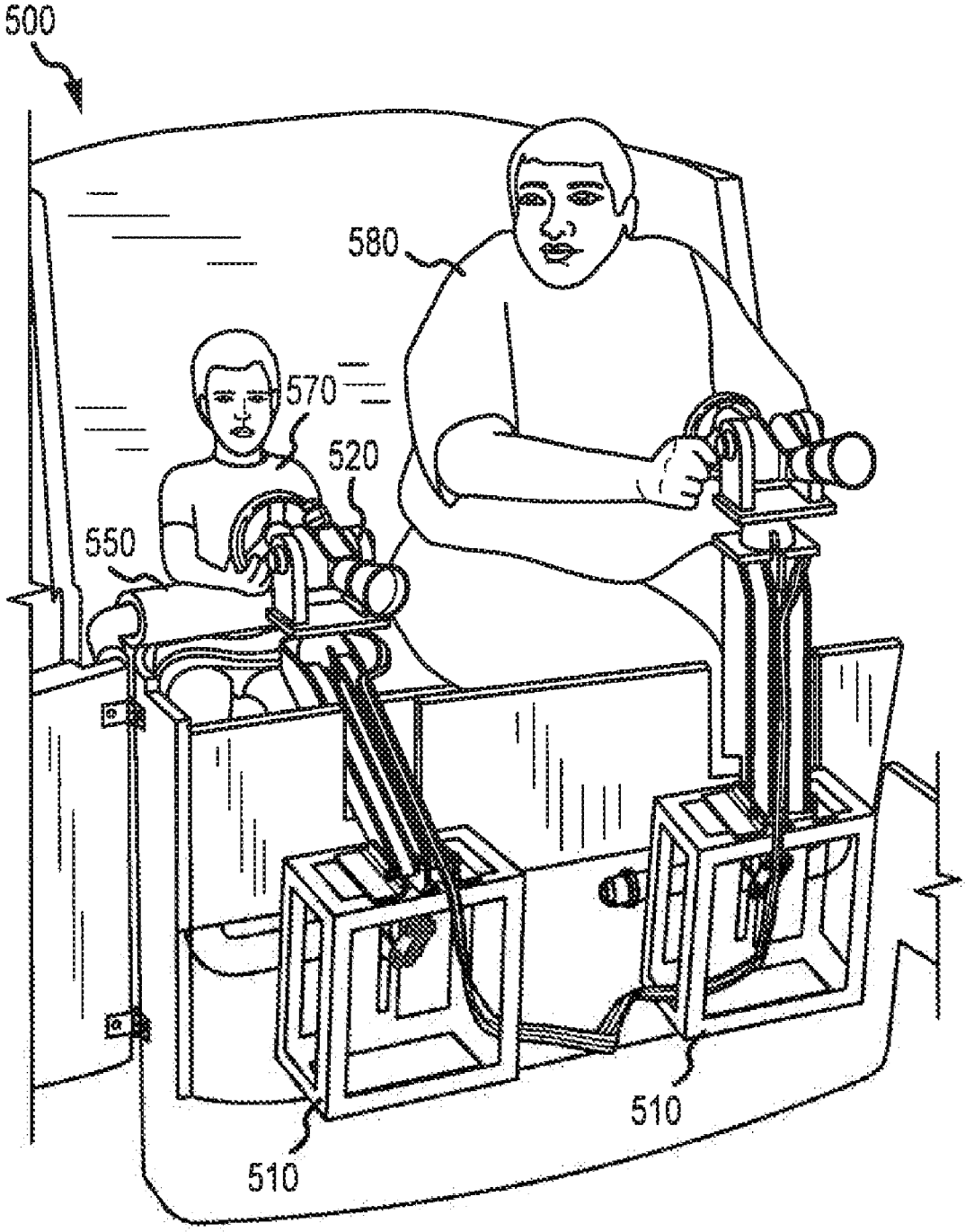
FIGS. 5 and 6 illustrate an embodiment of a vehicle assembly (such as may be used in the system of FIG. 1) showing one mounting and interconnection assembly of the invention.
Figure 6:
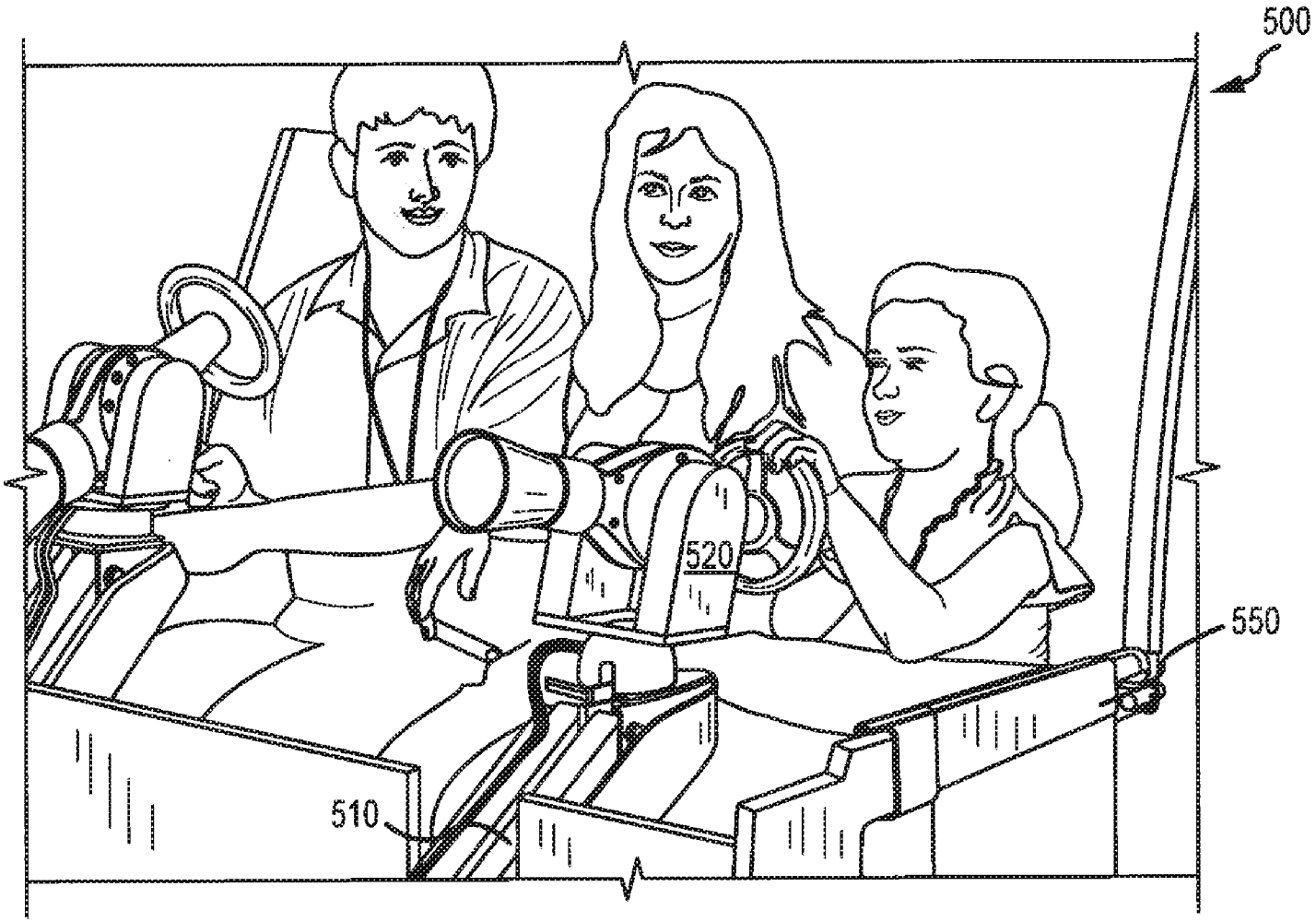

FIGS. 5 and 6 illustrate a vehicle assembly or body 500 (as may be used for vehicle assembly 130 of FIG. 1). The vehicle assembly 500 includes a mounting assembly 510 of the present invention for positioning an interactive device 520 based on relative movement/positioning of a lap bar 550. The vehicle body 500 is shown with a floor or base upon which the frame of the mounting assembly 510 may be rigidly attached. A crossbar of the lap bar 550 is pivotally attached to a side of the frame to allow the lap bar 550 to be positioned relative to a small guest or passenger 570 and also relative to a larger passenger 580, e.g., a small torso or lapped guest and a larger torso or lapped guest. As discussed above with reference to FIGS. 2-4, the positioning of the interactive interface 520 is achieved by a mounting plate and other multi-joint components of the mounting assembly 510 such that the interface 520 moves with and/or based on movement of the lap bar 550, with movement typically not being consistent or linear along the entire path of the movement (e.g., less at the beginning portion of the path to place the interactive device 520 in position for use by the larger guest and much more at the ending portion to place the interactive device 520 in position for use by a smaller guest as is shown).

Figure 7:
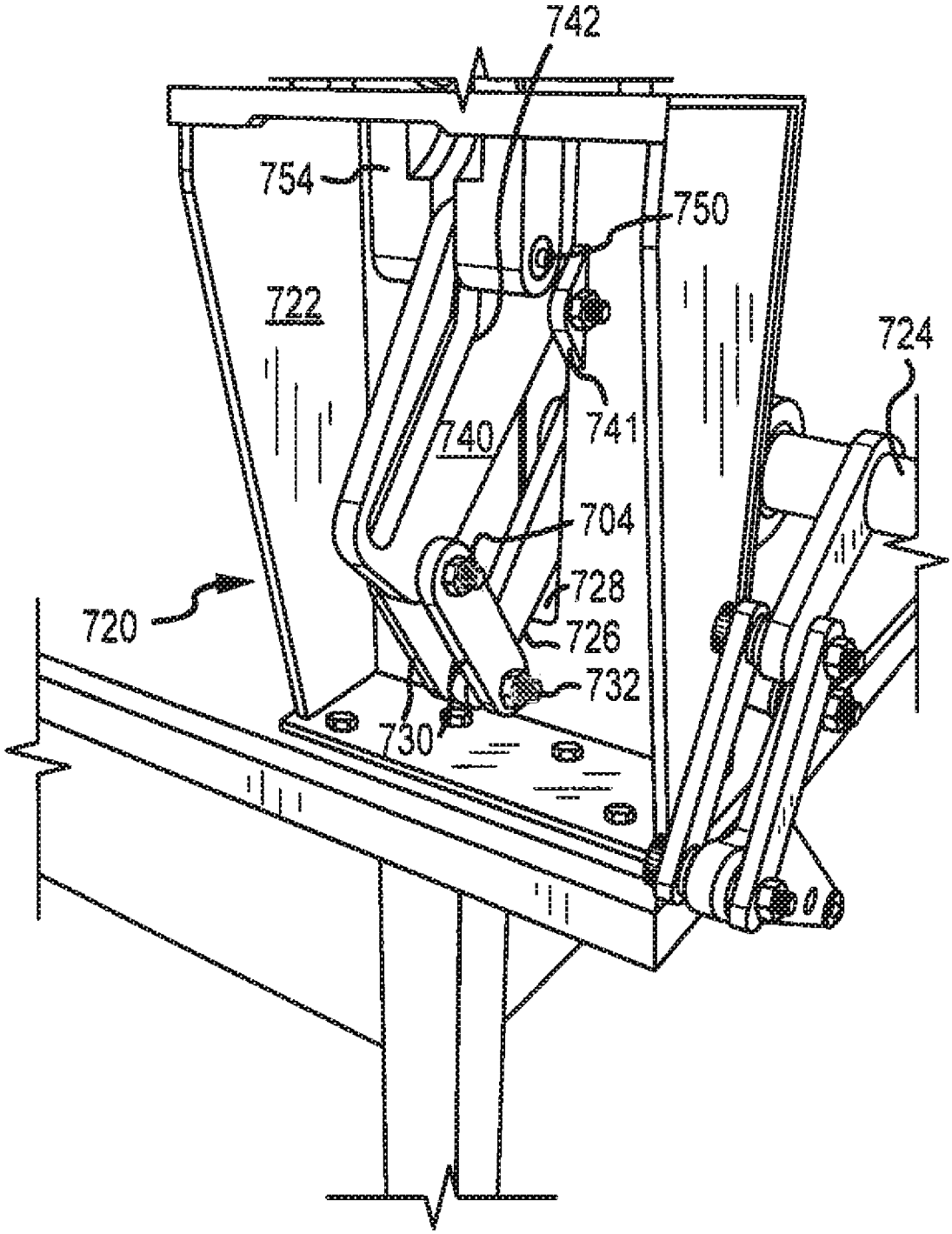
FIGS. 7 and 8 illustrate an embodiment of a mounting assembly of the present invention.
Figure 8:
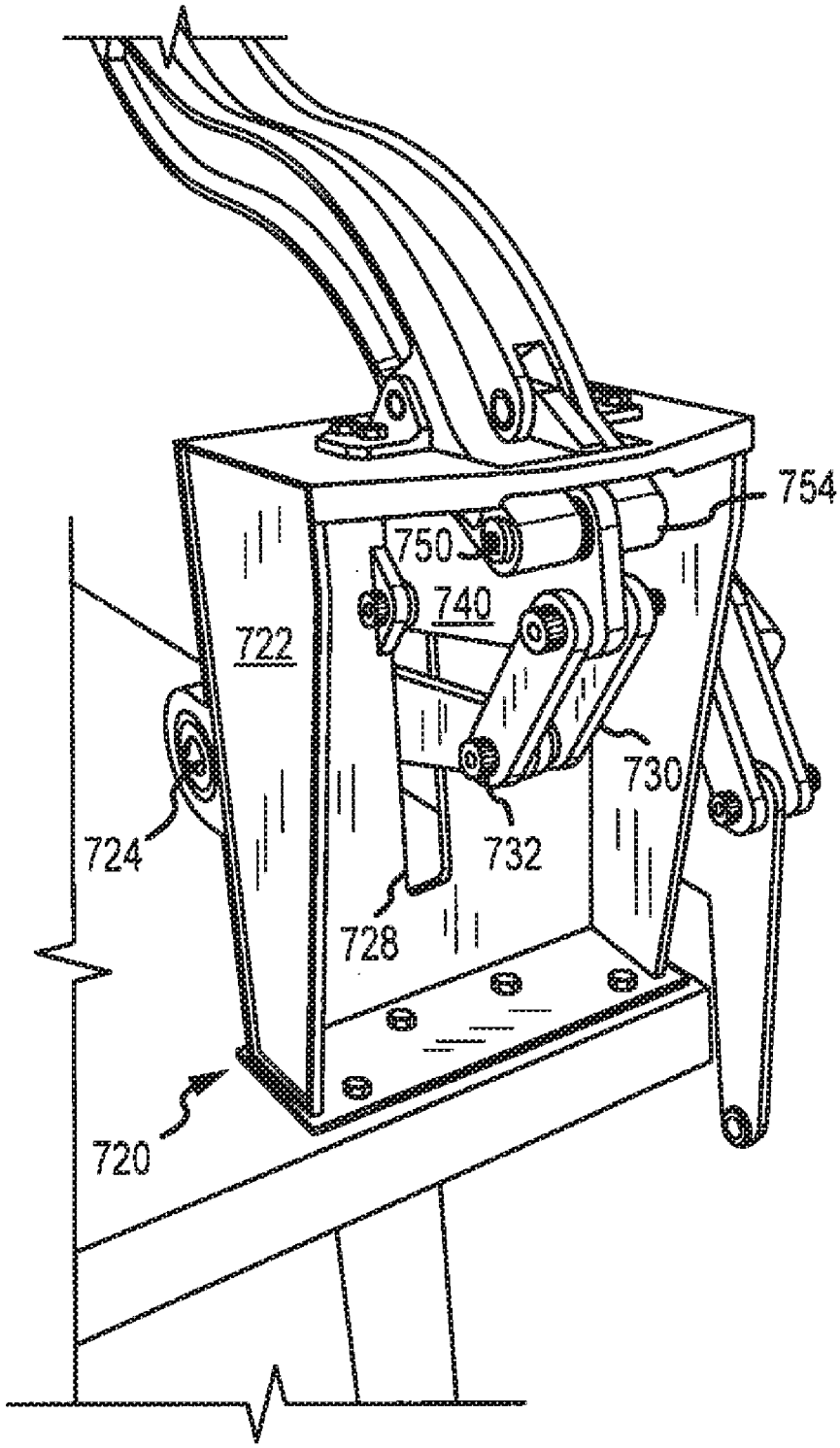

FIGS. 7 and 8 illustrate a mounting assembly 720 in more detail. As shown, the assembly 720 includes a frame or support structure 722 that may be attached to a vehicle body (such as to the floor or base of such a body). A crossbar 724 that would be attached to a lap bar (e.g., via a rod or arm) is pivotally mounted to the frame 722 (such as via sleeves or bearing surfaces/elements attached to an external surface of the frame 722 or via openings in one or more side plates). An extension or link 726 is affixed to the crossbar 724 to move with the crossbar 724 (e.g., to move up and down with the bar 724 as it rotates about its central or longitudinal axis), and the extension 726 extends through an opening or window 728 in the frame 722 (e.g., through its back wall or wall near a passenger seat (not shown)). The extension 726 is pivotally attached via pin or fastener 732 to a pair of links or arms 730 that are, in turn, pivotally attached at an opposite end to a guide plate 740 via pin or fastener 734.

As a result, the plate 740 is caused to move with the rotation of the crossbar 724 via extension 726 and links 730, e.g., about its mounting point to frame 722 at shoulder/pin(s) 741. The plate 740 includes a guide slot 742 in which another pin or bearing member 750 rides, and the pin or member 750 is pivotally attached to arm or rod 754 (which in turn is attached (e.g. rigidly affixed) to an interactive device such as discussed above with reference to FIGS. 2-4). The guide slot 742 may be linear to cause a direct correspondence between movement/positioning of the interactive device and the crossbar 724 or, as shown, be non-linear (e.g., hockey stick shaped or the like) to achieve a smaller amount of movement of the interactive device during initial rotation of the crossbar 724 followed by a larger amount of movement (which may be achieved, by example, with a hockey stick or similar shaped slot having a shorter arm or groove length proximate to the load/unload position which is shown in FIG. 7, and a longer arm or groove length proximate to the later stages of crossbar rotation).

Figure 9A:
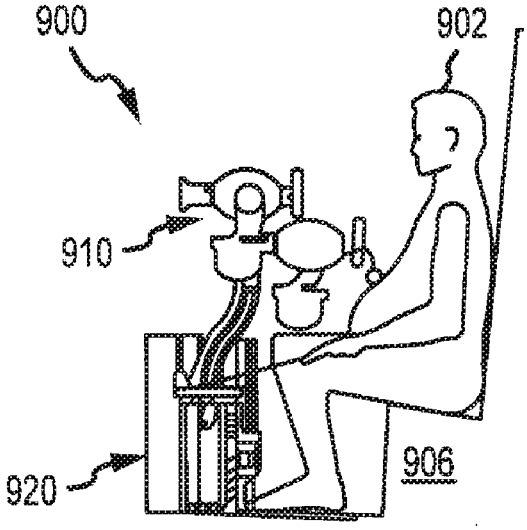
FIGS. 9A and 9B illustrate side views of a vehicle assembly from a first side showing a larger passenger and relative positioning of the GID and lap bar and a second side showing a smaller passenger and positioning of the GID and lap bar.
Figure 9B:
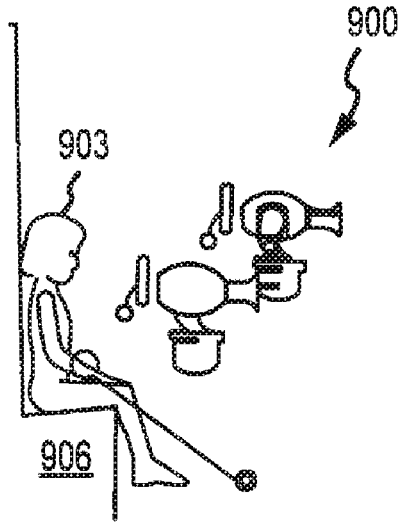

FIGS. 9A and 9B illustrate side views of a vehicle assembly 900 illustrating use of mounting assemblies (with one being provided for each GID in this embodiment) as shown at 920 to provide a positioning of a GID relative to guest or passenger 902, 903 positioned in a vehicle seat 906. Significantly, as shown, the mounting assembly 920 can be used to position the GID 910 in differing positions based on the size of the guest 902, 903 or their upper bodies (laps and/or torsos). These figures illustrate that for a particular vehicle two GIDs paired with separate lap bars or restraints may be provided and positioned at differing distances relative to a vehicle seat (e.g., differing lateral spacing as well as vertical spacing or relative heights). The GIDs are interconnected to the lap bars and are also moved differing amounts to allow the GIDs to be effectively positioned and/or automatically adjusted to suit differing passengers based on passenger restraints positioning near the laps/torsos of the passengers.

Figure 10:
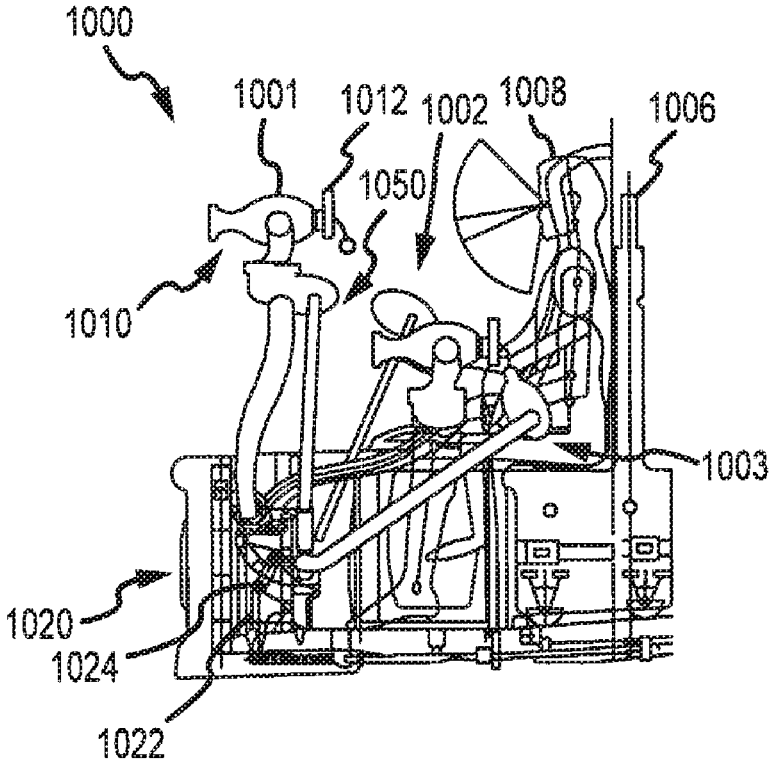
FIG. 10 illustrates a side view of a vehicle assembly including a mounting assembly providing an interconnection between a lap bar restraint and an interactive device or user input device with varying positions of the lap bar and GID being shown.
Figures 11A, 11B, 11C, 11D:
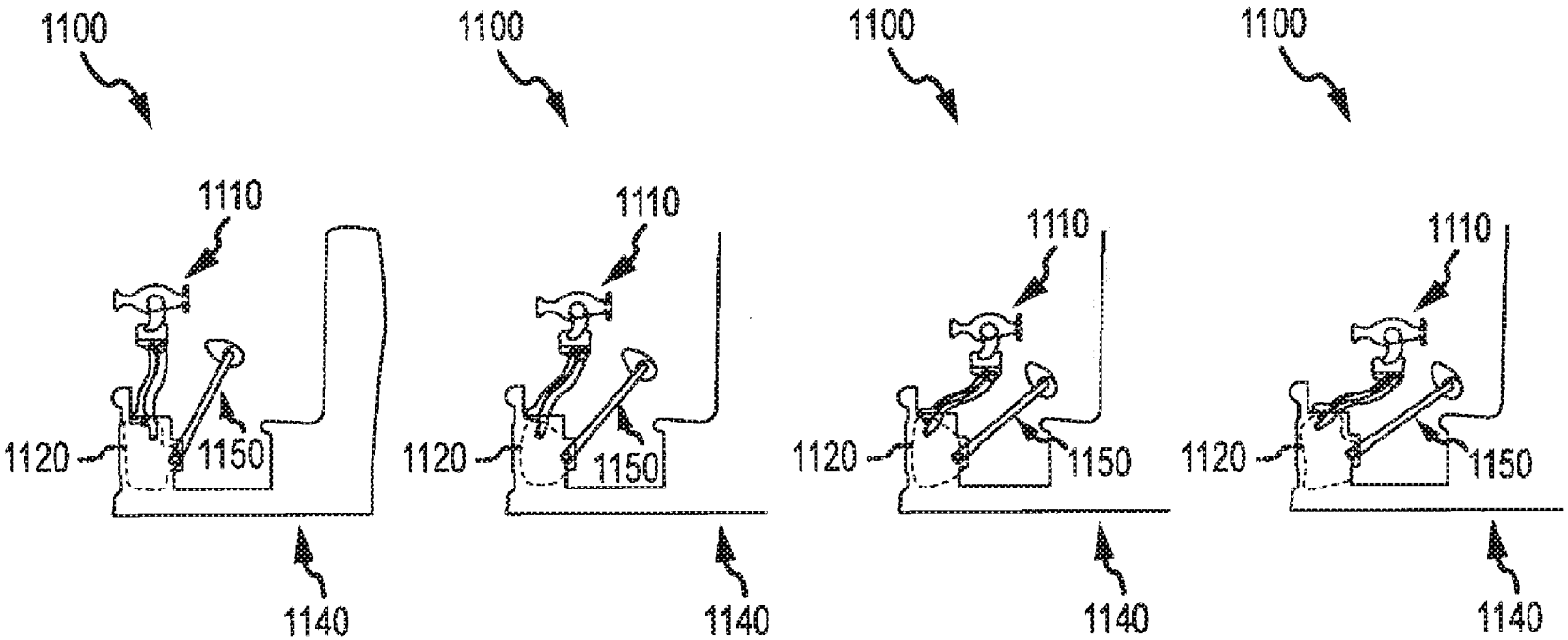
FIGS. 11A-11D provide side views of a vehicle assembly of the invention utilizing a mounting assembly of an embodiment of the invention in a variety of locked/passenger restraint positions of the passenger restraint and linked interface device.

FIG. 10 illustrates in more detail a vehicle assembly 1000 similar to those that may be used in system 100 of FIG. 1 and in FIGS. 9A and 9B. As show the lap bar 1050 can be rotated from an unload/load position (shown at 1001) through a first position (shown at 1002) where it may stop if a larger passenger/guest 1008 is seated in the vehicle seat 1006 to a second position (shown at 1003) or second passenger restraint position. In this second position 1003, the GID is positioned, via the mount assembly 1020 that links it to the restraint 1050, below the line of sight of the guest/passenger 1008 allowing them to view the displayed show or ride effects and also allowing them to easily reach the GID 1010 and its user interface or triggering portion shown with a wheel and triggering ball/pull 1012. As discussed throughout this description, the amount of movement or rotation of the lap bar 1050 defines or dictates the amount of movement of the GID 1010 via the mounting assembly 1020 (which may take the form shown in FIGS. 5-8 or the form shown in FIGS. 2-4 or another useful configuration) that interconnects these two components of assembly 1000. In many embodiments, the GID 1010 is moved more slowly or a smaller distance/amount of rotation as the lap bar 1050 is initially moved or rotated from the load/unload position 1001 to first locked/restraint position 1002 and then more quickly (or at a second or more rate) during a second or later portion as the lap bar 1050 travels toward a smaller guest/passenger 1008 and the second locked/restraint position 1002. The mounting assembly 1020 may be configured similarly to the assembly 720 of FIGS. 7 and 8, but it may take the form shown in FIG. 10 and, in some cases, the connecting link 1024 connecting the restraint cross bar to the guide or guide plate may be counterbalanced with a balance/vibration control element 1022. Again, as discussed above, the particular linkage assembly chosen for connecting the passenger restraint 1050 to the interactive device 1010 may be varied to practice the invention and numerous modifications to the assemblies shown herein will be readily apparent to those skilled in the art based on the teaching provided in these paragraphs and with reference to the attached figures.

FIGS. 11A-11D illustrate a GID 1110 and a lap bar assembly 1150 that would are interconnected by components of a mounting assembly 1120 (e.g., any embodiment or similar assembly as described herein) to provide differing positioning (or positioning that may differ) within a single vehicle body 1140 (e.g., for an adult passenger and a child or for two children or two adults of differing size). These figures are useful for showing the relative positions of the device 1110 and restraint 1150 as the restraint 1150 is moved out of the load/unload position (not shown where the restraint bar may generally be vertical or at a smaller angle relative to a vertical plane) through four locked/passenger restraint positions that may be associated with four differing sized individuals in the seat/bench of the body 1140, with the largest passenger seated in FIG. 11A and the smallest in FIG. 11D. As can be seen, the restraint 1150 moves more initially relative to the GID 1110, which creates a gap between the GID 1110 and restraint 1150 but as the restraint moves further (e.g., through the positions shown in FIGS. 11C and 11D) the GID 1110 is moved more or at a larger magnitude than the restraint 1150, which causes this GID-restraint separation distance to lessen.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. The mounting assembly and other components may be modified and provided with components of differing configuration and/or number to achieve similar functionality. For example, the mounting assemblies of embodiments of the invention may include stiffeners and/or supports to increase durability of the assembly and increase rigidity of one or more members of the assembly. Links, extensions, bars, cam/guide plates, and other components may take the forms shown or be reshaped to provide a desired function and/or to fit within a particular area or volumetric constraints. Also, a spring or other resilient element (or other device) may, be added to the mounting mechanism to function to assist a passenger in returning the lap bar or other passenger restraint and connected GID to the load/unload position (e.g., after release of the lap bar or restraint from its locked position the resilient or other return element may act to provide a return force to its "at rest" position). Additional sensors may be provided to determine locations of the GID. For example, a sensor may be provided to track the position of the mount such as to allow where the whole GID is in space (e.g., how high and how far back and so on). The sensor may be provided in the bottom of the mount assembly or elsewhere, and the GID position information may be used by the ride system to "draw" virtual projectiles and the like coming out of the GID or otherwise related to the position, with the height being relevant to generate a display that looks good/accurate to passengers/guests.

The description of passenger restraints is intended to include nearly all types of restraints that may be moved into position at the beginning of a ride to secure a passenger or guest in a vehicle, and the invention is not limited to lap bar-type restraints. For example, a GID may be interconnected with a over-the-shoulder passenger restraint using the mounting assembly embodiments to position the GID based on the swing, rotation, or positioning of this type of restraint similar to the concurrent and "automated" positioning of the GIDs achieved with lap bars. Similarly, the interactive devices or GIDs are intended to include nearly any type of device provided in a ride vehicle to allow a guest or passenger to interact with ride or game features or elements. For example, the GID may be any display device, a monitor with significant or limited interaction with the user (e.g., may simply be a monitor or display screen), and/or a touch screen.

In some embodiments, a GID as described herein may be provided for vehicles that are wheelchair accessible. In these cases, the passenger restraint may be a restraint that is linked to the GID and that restrains the wheelchair rather than being a lap bar or similar restraint for passengers in a vehicle seat. In some embodiments, the "passenger restraint" that is mechanically linked to the GID is a lever that is operable by a cast member/operator who assists a passenger or guest in a wheelchair. The lever or restraint is moved or rotated by the operator until the GID is in an appropriate or desired position for the guest (e.g., a lever may be a portion of the assemblies shown such as the portion extending toward the lap bar with the lap bar being left out or removed from the assembly to facilitate loading of a wheel chair).

The description stresses embodiments where the GID and the restraint are pivotally mounted and interconnected via a mounting assembly. In other embodiments (not shown), the GID may be mounted such that it moves linearly toward the guest or in another travel path while the restraint is rotated (or vice versa). In other cases, the GID may pivot side to side rather than toward the guest when the restraint is moved into position relative to a seated guest/passenger. These embodiments are considered to be within the breadth of the above description and following claims as the description clearly describes the concept and functionality of interconnecting a restraint with a movable/positionable GID and is not limited to particular movement of either the GID or restraint.

We claim:

1. An apparatus for providing mounting an interactive device in a ride or show vehicle that includes a passenger restraint to protect a passenger of the vehicle, comprising:

a support frame rigidly attached to the vehicle;

an attachment mechanism for pivotally attaching the interactive device to the support frame; and a drive mechanism for linking the passenger restraint to the attachment mechanism, wherein movement of the passenger restraint from a loading and unloading position to a position to restrain a passenger within the vehicle drives the interactive device from a loading and unloading position to an interactive use position.

2. The apparatus of claim 1, wherein the drive mechanism comprises a guide element causing the interactive device to move at a first rate relative to the passenger restraint during a first portion of a travel path of the passenger restraint and at a second rate relative to the passenger restraint during a second portion of the travel path, the second rate being greater than the first rate and the first portion of the travel path being proximate to the loading and unloading position of the passenger restraint.

3. The apparatus of claim 2, wherein the guide element comprises a guide plate with a guide slot having a first region associated with the first portion of the travel path and a second region associated with the second portion of the travel path.

4. The apparatus of claim 3, wherein the passenger restraint is pivotally mounted to the support frame and connected to the guide plate such that the guide plate moves concurrently with the passenger restraint.

5. The apparatus of claim 4, wherein the drive mechanism includes a driver linkage connected at a first end to the guide plate via the guide slot and at a second end to the attachment mechanism of the interactive device, whereby the interactive device is positioned concurrently with the passenger restraint.

6. A vehicle assembly for use in an interactive ride, comprising:

a body with a seat for a guest;

a mounting assembly attached to the body a distance from the seat;

a lap bar restraint pivotally mounted to the mounting assembly and including a lap bar positionable in a load and unload position and in a guest restraint position; and a guest interactive device pivotally mounted to the mounting assembly, wherein the mounting assembly comprises an interconnection assembly connecting the lap bar restraint to the guest interactive device such that when the lap bar is moved through a path from the load and unload position to the guest restraint position the guest interactive device is concurrently moved from a load and unload position distal from the seat to a guest interaction position proximate to the seat.

7. The assembly of claim 6, wherein the path of the lap bar includes a first portion proximate to the load and unload position and a second portion distal to the load and unload position and wherein the lap bar and the interactive device are spaced apart a separation distance that varies over the path of the lap bar and is greater in the first portion.

8. The assembly of claim 7, wherein the interactive device is moved laterally at a first rate during the first portion and at a second rate during the second portion, the second rate being greater than the first rate.

9. The assembly of claim 6, wherein the interactive device includes a planar base pivotally attached to an arm extending from the mounting assembly, the arm being providing the pivotal mounting the mount assembly, whereby the planar base is maintained in a substantially consistent position relative to a platform or floor supporting the body during movement of the lap bar along the path from the load and unload position to the guest restraint position.

10. A ride vehicle for use in an amusement or theme park ride with interactive game or show equipment, comprising:

a vehicle body with a seat for receiving a passenger;

an interactive device operable by the passenger to interact with the interactive equipment;

a mounting assembly pivotally mounting the interactive device on the vehicle body, wherein the mounting assembly is operable to rotate the interactive device through a range of positions at varying distances from the seat; and means for defining a size of the passenger in the seat, wherein the size defining means provides input to the mounting assembly to drive the mounting assembly to place the interactive device at a passenger-use position within the range of positions selected based on the defined size of the passenger.

11. The ride vehicle of claim 10, wherein the size defining means comprises a passenger restraint linked to the interactive device by the mounting assembly, whereby movement of the passenger restraint to a passenger restraint position proximate the passenger drives the interactive device to the passenger-use position.

12. The ride vehicle of claim 11, wherein the passenger restraint comprises a lap bar-type restraint pivotally connected to the mounting assembly, whereby rotating the lap bar-type restraint into the passenger restraint position at least partially concurrently rotates the interactive device via the mounting assembly into the passenger-use position.

13. The ride vehicle of claim 12, wherein the mounting assembly comprises a variable drive element configured to rotate the interactive device in response to rotation of the lap bar-type restraint at two or more rotation rates relative to movement of the lap bar-restraint.

14. The ride vehicle of claim 13, wherein the variable drive element comprises a guide plate with a guide slot with at least two portions each associated with the two or more rotation rates and initial rotation rates associated with a load and unload position for the lap bar-type restraint are smaller in magnitude than later rotation rates associated with the passenger restraint position for the lap bar-type restraint.

15. The ride vehicle of claim 14, wherein the portion of the guide plate slot associated with the initial rotation rate is oriented at an angle less than about 30 degrees from vertical.

16. The ride vehicle of claim 10, wherein the size defining means comprises a passenger restraint pivotally connected to the mounting assembly and wherein the input provided to the mounting assembly from the size defining means comprises a restraint rotation amount.

17. The ride vehicle of claim 16, wherein the mounting assembly includes a linkage assembly that links the passenger restraint to the interactive device such that interactive device rotates a device rotation amount in response to the rotation of the passenger restraint, the device rotation amount differing in magnitude from the restraint rotation amount.

18. The ride vehicle of claim 17, wherein the linkage assembly is configured to provide an at least partially non-linear relationship between the rotation of the interactive device and the rotation of the passenger restraint, the interactive device rotating at two or more rates during the rotation of the passenger restraint.

19. The ride vehicle of claim 18, wherein a first of the two or more rates is associated with a first portion of the rotation of the passenger restraint from a load/unload position toward the seat and a second of the two or more rates is associated with a second portion of the rotation of the passenger restraint more proximate to the seat, the first rate being less than the second rate of rotation for the interactive device.

20. The ride vehicle of claim 10, further comprising a mounting plate for the interactive device and a support pivotally mounted to the mounting plate at a first end and to the mounting assembly at a second end, wherein the support is linked to the size defining means via the mounting assembly to cause the support to rotate as the interactive device is placed in the passenger-use position and wherein the mounting plate is maintained in a planar orientation through the support rotation to maintain the interactive device in a device use position.

* * * * *